US008651028B2

(12) United States Patent
Storteboom et al.

(10) Patent No.: US 8,651,028 B2
(45) Date of Patent: Feb. 18, 2014

(54) SEPARBLE BLOCK SHIPPING PLATFORM

(71) Applicant: CHEP Technology Pty Limited, Sydney (AU)

(72) Inventors: John Thomas Storteboom, Orlando, FL (US); Oivind Brockmeier, Medford, MA (US); Brandon M. D'Emidio, Orlando, FL (US); Timothy R. Proulx, Nashua, NH (US); Gregory S. Burkett, Cambridge, MA (US); Jeffrey R. Chapin, Cambridge, MA (US); Kenneth M. Brandt, Orlando, FL (US)

(73) Assignee: Chep Technology Pty Limited, Sydney NSW (AU)

( * ) Notice: Subject to any disclaimer, the term of this patent is extended or adjusted under 35 U.S.C. 154(b) by 0 days.

(21) Appl. No.: 13/716,091

(22) Filed: Dec. 15, 2012

(65) Prior Publication Data

US 2013/0152832 A1 Jun. 20, 2013

Related U.S. Application Data

(60) Provisional application No. 61/576,984, filed on Dec. 17, 2011.

(51) Int. Cl.
*B65D 19/12* (2006.01)

(52) U.S. Cl.
USPC ..... 108/56.1; 108/57.25; 108/901

(58) Field of Classification Search
USPC ..... 108/56.1, 56.3, 901, 902, 51.11, 57.26, 108/57.22, 57.25
See application file for complete search history.

(56) References Cited

U.S. PATENT DOCUMENTS

| | | | | | |
|---|---|---|---|---|---|
| 3,407,758 | A * | 10/1968 | Simkins | 108/56.3 |
| 3,664,271 | A * | 5/1972 | Wolder et al. | 108/901 |
| 3,824,933 | A * | 7/1974 | Lind | 108/56.1 |
| 3,835,792 | A * | 9/1974 | Wharton | 108/56.1 |
| 4,128,253 | A * | 12/1978 | Powers | 108/56.1 |
| 4,382,414 | A * | 5/1983 | Svirklys | 108/56.1 |
| 4,799,433 | A * | 1/1989 | Luft | 108/57.26 |
| 5,176,465 | A * | 1/1993 | Holsted | 108/56.3 |
| 5,483,899 | A * | 1/1996 | Christie | 108/56.3 |
| 5,887,529 | A * | 3/1999 | John et al. | 108/56.1 |
| 6,029,583 | A * | 2/2000 | LeTrudet | 108/57.25 |
| 6,109,190 | A * | 8/2000 | Hale et al. | 108/57.25 |
| 6,123,492 | A * | 9/2000 | Pickard | 411/508 |
| 6,513,280 | B2 * | 2/2003 | Roberts | 248/346.11 |
| 6,742,460 | B2 * | 6/2004 | Meyer et al. | 108/57.25 |
| 6,840,181 | B2 * | 1/2005 | Smyers | 108/901 |
| 7,431,531 | B2 * | 10/2008 | Carnevali | 403/328 |
| 7,748,329 | B2 * | 7/2010 | Baltz | 108/56.1 |
| 7,779,765 | B2 * | 8/2010 | Donnell et al. | 108/901 |
| 8,006,629 | B2 * | 8/2011 | Naidu | 108/56.3 |
| 2007/0234933 | A1 * | 10/2007 | Donnell et al. | 108/56.3 |

* cited by examiner

*Primary Examiner* — Jose V Chen
(74) *Attorney, Agent, or Firm* — Ido Tuchman

(57) ABSTRACT

A shipping platform system may include a top deck, and a top block joined to the top deck. The system may also include a bottom deck, and a bottom block joined to the bottom deck. The system may further include a joint that yields under a predetermined load that joins the top block to the bottom block.

17 Claims, 17 Drawing Sheets

SEPARBLE BLOCK SHIPPING PLATFORM

RELATED APPLICATIONS

This application claims the benefit of U.S. Provisional Patent Application No. 61/576,984, filed on Dec. 17, 2011, entitled "Separable Block Shipping Platform", the entire subject matter of which is incorporated herein by reference in its entirety.

BACKGROUND

Shippers, manufacturers, wholesalers, retailers, and/or the like move merchandise, materials, and/or the like (e.g. load, to customers, end-users, and/or the like) on shipping platforms (e.g. pallet, containers, and/or the like). This technique of bulk shipping may reduce the cost related to moving the load when compared to non-bulk shipping methods. As a result, all parties in the distribution chain may benefit from lower shipping costs due to this bulk shipping technique.

There are a number of issues with the above described technique. One issue is that shipping platforms are exposed to a harsh operating environment. Another issue is the shipping platform may be restricted in any number of ways by regulatory and/or standardization requirements.

SUMMARY

According to one embodiment, a shipping platform system may include a top deck, and a top block joined to the top deck. The system may also include a bottom deck, and a bottom block joined to the bottom deck. The system may further include a joint that yields under a predetermined load that joins the top block to the bottom block.

The joint may comprise interlocking surfaces. One interlocking surface may include a male fitting and another interlocking surface may include a female fitting that mates with the male fitting. The mated male fitting and the female fitting may produce an interference fit that yields at a selected threshold.

One interlocking surface may include a channel and another interlocking surface may include a retainer that engages the channel. The system may also include a frangible member that joins the channel and the retainer together. The frangible member may be replaceable. The frangible member may include a failure point.

One interlocking surface may include a spring and another interlocking surface may include a catch that engages the spring. The catch may release the spring at a selected threshold.

Another aspect of the embodiments is a method. The method may include joining a top block to a top deck. The method may also include joining a bottom block to a bottom deck. The method may further include joining the top block to the bottom block through a joint that yields under a predetermined load.

The method may also comprise including interlocking surfaces as part of the joint. The method may further include mating one interlocking surface that includes a male fitting to another interlocking surface that includes a female fitting. The method may additionally include providing an interference fit that yields at a selected threshold between the mated male fitting and the female fitting.

The method may also include joining one interlocking surface that includes a channel to another interlocking surface that includes a retainer that engages the channel. The method may further include joining the channel and the retainer together via a frangible member. The method may additionally include making the frangible member replaceable. The method may also comprise including failure points on the frangible member.

The method may further include engaging a spring carried by one interlocking surface with a catch carried by another interlocking surface. The method may additionally include releasing the spring at a selected threshold by the catch.

DETAILED DESCRIPTION

Embodiments will now be described more fully hereinafter with reference to the accompanying drawings, in which preferred embodiments are shown. Like numbers refer to like elements throughout.

Figure 1:
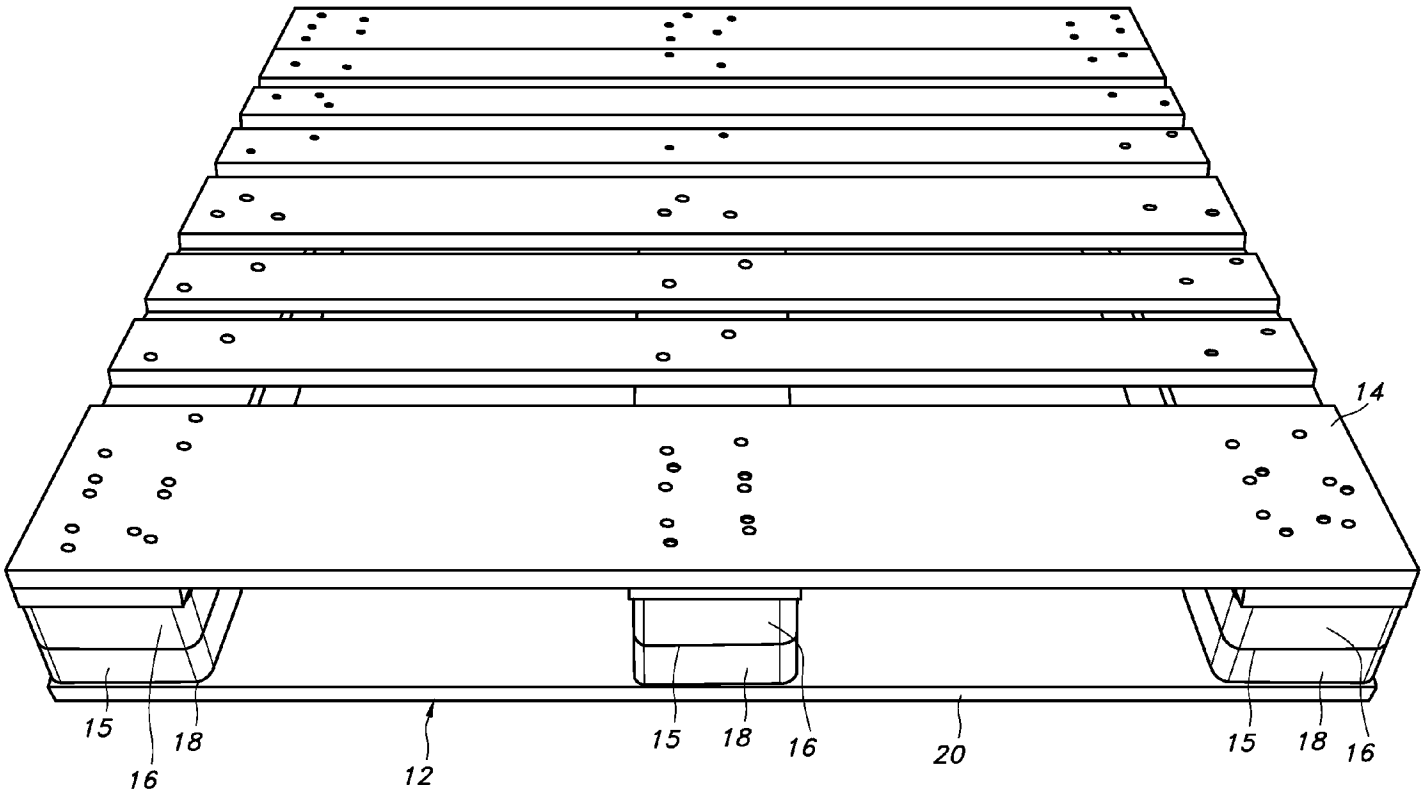
FIG. 1 illustrates a separable block shipping platform in accordance with the invention.
Figure 2:
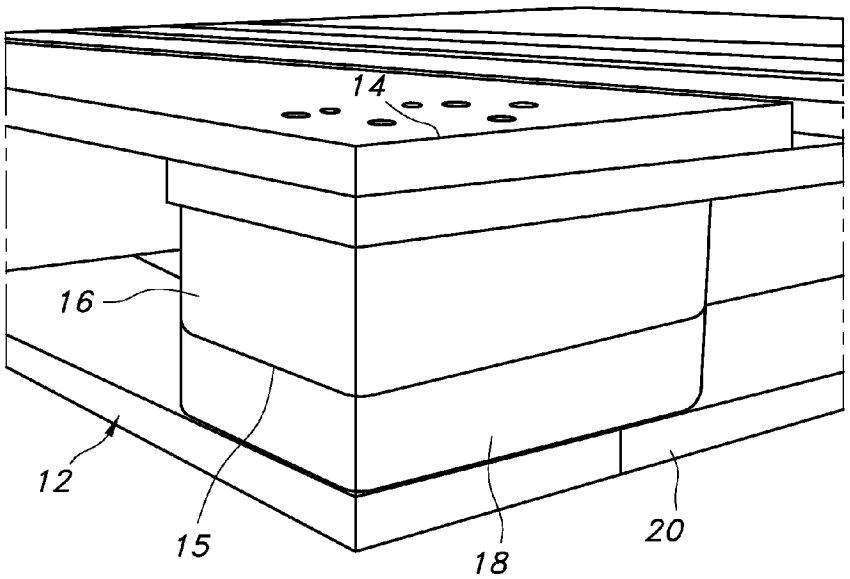
FIG. 2 illustrates a close-up of the separable block of FIG. 1.

FIGS. 1 and 2 illustrate a system 10 for a shipping platform 12 that is often referred to as a pallet. In this embodiment, the shipping platform 12 is fabricated out of a top deck 14 joined to an adjoining top block 16, that is joined to an adjoining bottom block 18, that is joined to an adjoining bottom deck 20. The top deck 14, the top block 16, the bottom block 18, and/or the bottom deck 20 comprise wood, metal, plastic, composite materials, and/or the like.

In one embodiment, the joining of the top deck 14 to the top block 16, as well as the bottom block 18 to the bottom deck 20, utilizes fasteners such as nails, screws, dowels, and/or the like. This enables the top deck 14, the top block 16, the bottom block 18, and/or the bottom deck 20 of the shipping platform 12, e.g. pallet, to be replaced if damaged. In an alternative embodiment, the joining of the top deck 14 to the top block 16, as well as the bottom block 18 to the bottom deck 20, uses adhesives, curable resins, and/or the like.

Figure 3:
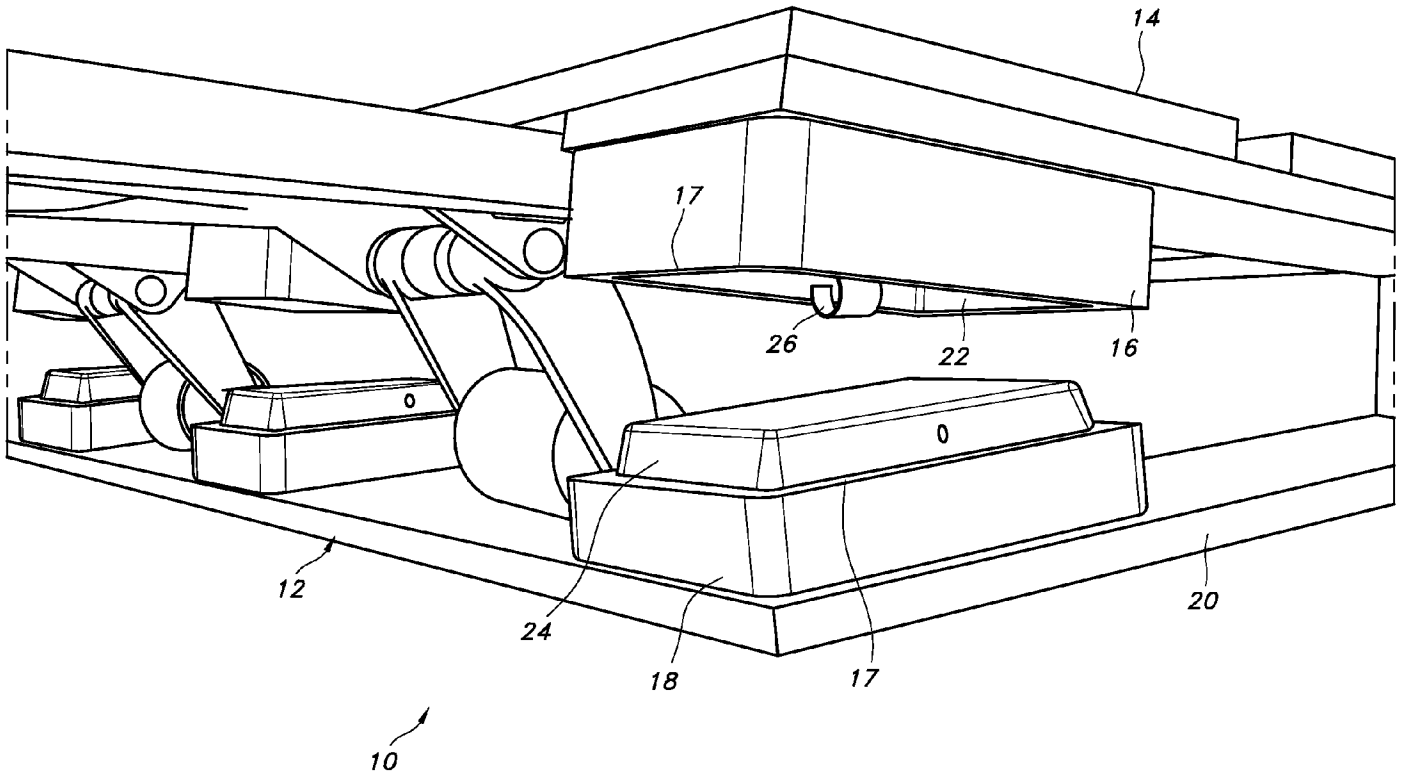
FIGS. 3 and 4 illustrate the separable block of FIG. 2 being separated.
Figure 4:
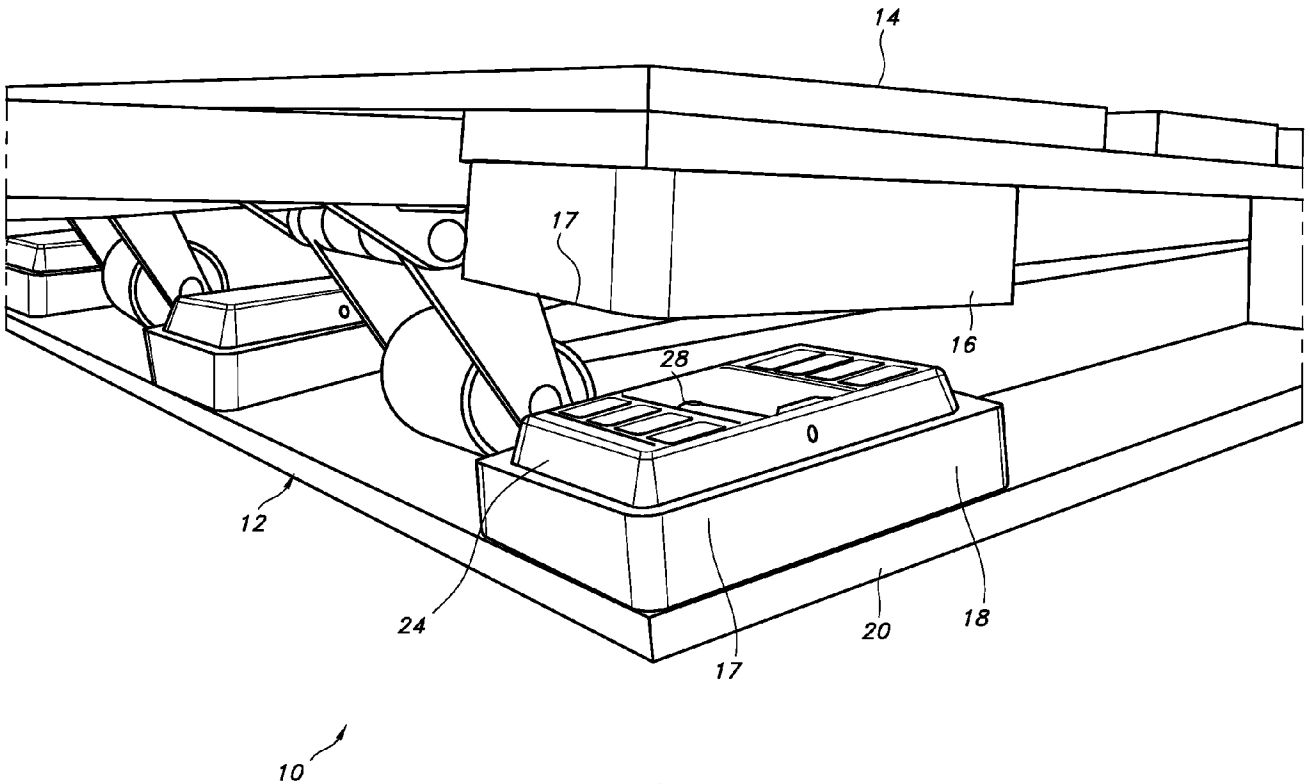
Figure 5:
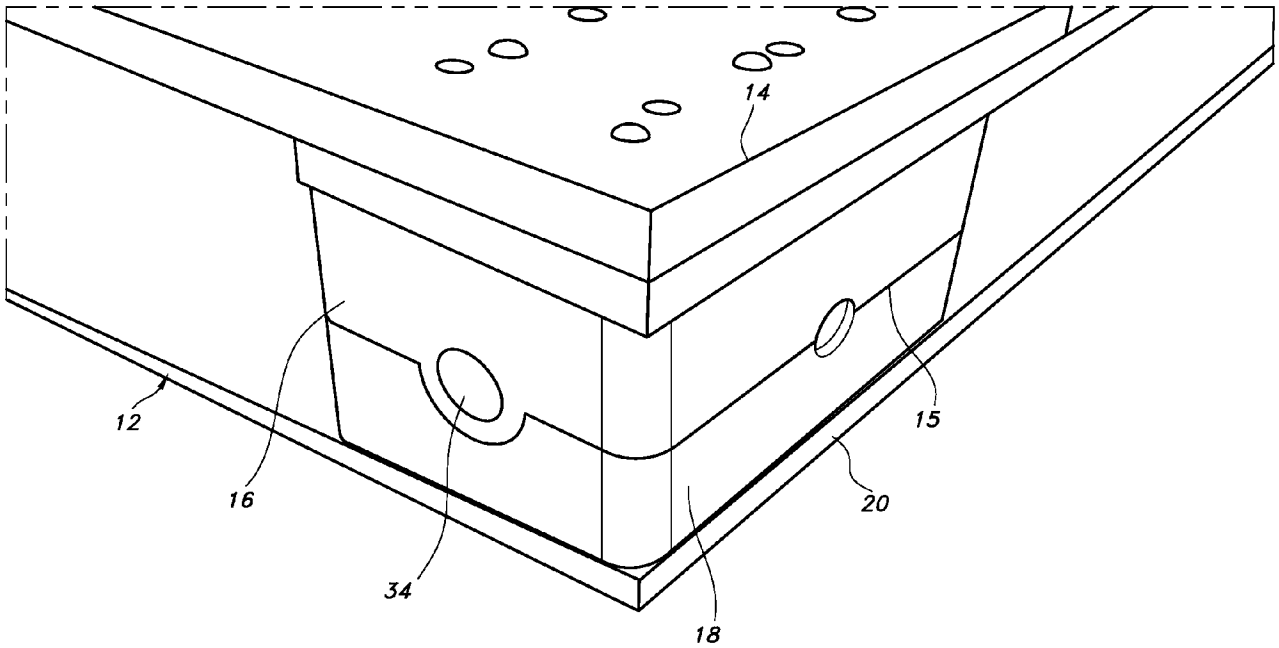
FIG. 5 illustrates an alternative separable block shipping platform in accordance with the invention.
Figure 7:
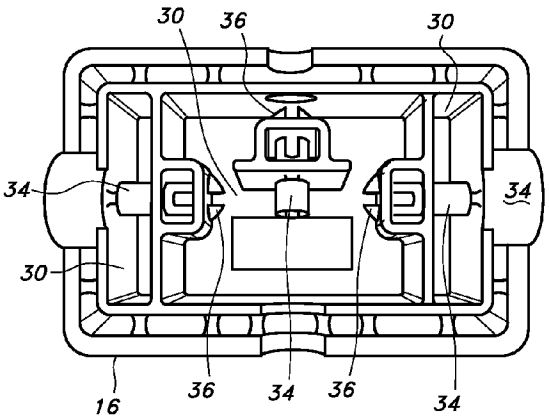
FIG. 7 illustrates the bottom block of FIG. 6 with frangible members inserted.
Figure 6:
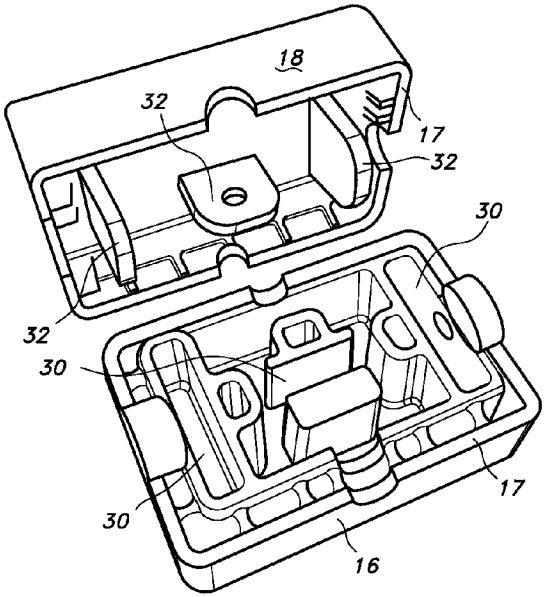
FIG. 6 illustrates the top block and bottom block of the separable block of FIG. 5.
Figure 8:
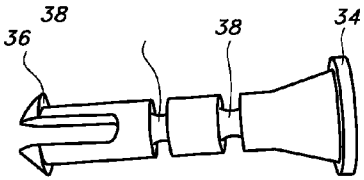
FIG. 8 illustrates the frangible member of FIG. 7.
Figure 9:
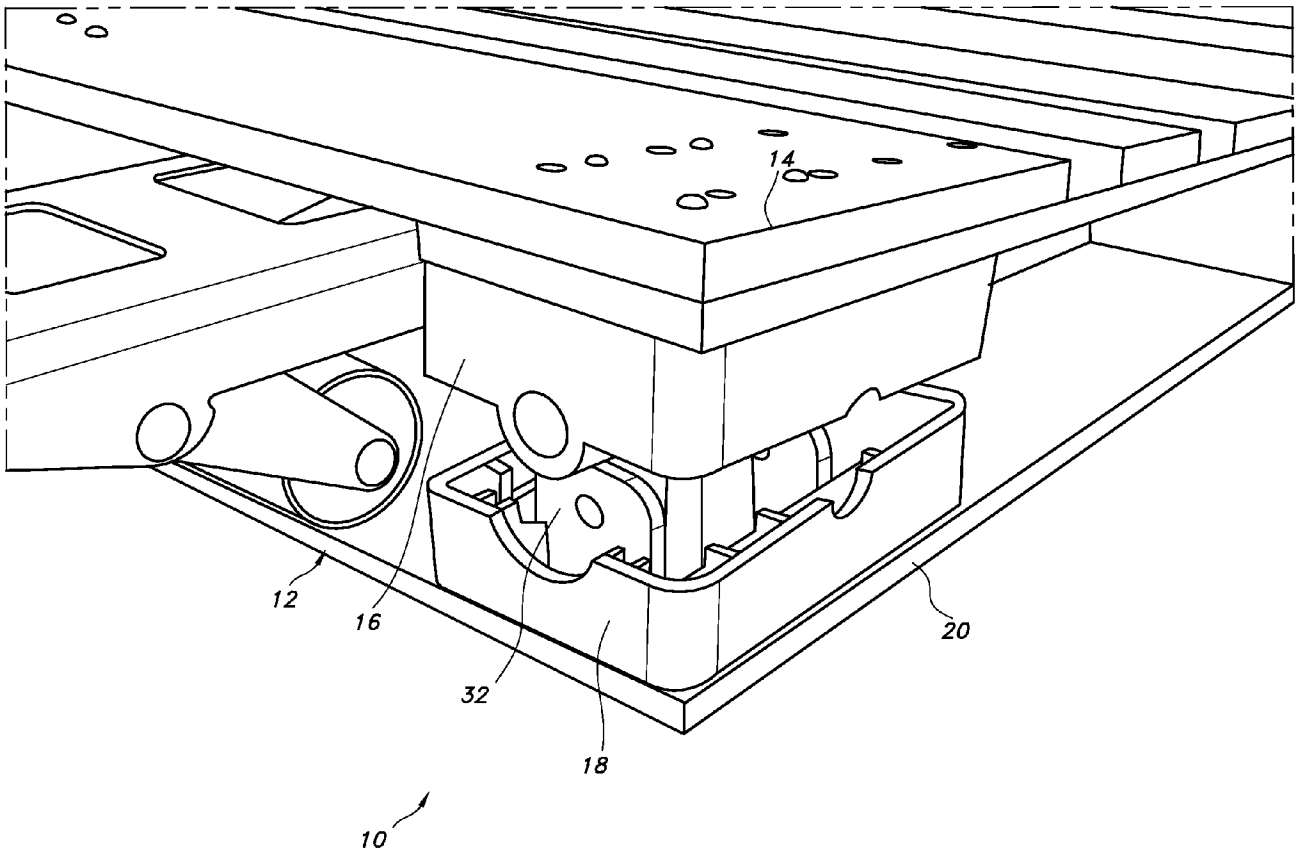
FIG. 9 illustrates the alternative separable block of FIG. 5 being separated.

With additional reference to FIGS. 3 and 4, the top block 16 and the bottom block 18 are joined by interlocking surfaces. For example, the top block 16 is a female fitting 22 and the bottom block 18 is a matched male fitting 24. In another embodiment, the top block 16 is a male fitting and the bottom block 18 is a matched female fitting. In another embodiment, the mating surfaces provide an interference fit that fails and/or yields at a predetermined threshold load. In other words, the top block 16 and the bottom block 18 would separate at the predetermined load during destructive pallet jacking (see FIGS. 3 and 7), for example, thus reducing damage to the pallet 12. Stated another way, the top block 16 and the bottom block 18 are designed to be separated and/or re-connected together. In one embodiment, the weight of the unit load on the pallet 12 would snap the top block 16 and the bottom block 18 back together.

In one embodiment, the top block 16 includes a spring 26, e.g. biasing member, that frictionally engages a catch 28 carried by the bottom block 18. The spring 26 is designed to release the catch 28 at a predetermined load threshold. In other words, the top block 16 and the bottom block 18 would separate at the predetermined load such as during a destruction pallet jacking incidence, for example, thus the system 10 reduces damage to the pallet 12. In another embodiment, the top block 16 includes the catch 28 that frictionally engages the spring 26 carried by the bottom block 18.

With additional reference to FIGS. 5-9, another embodiment of the system 10 is described. In this embodiment, the shipping platform 12 is once again fabricated out of a top deck 14 joined to a top block 16 that is joined to a bottom block 18 that is joined to a bottom deck 20 in a similar fashion and from similar materials as the prior described embodiments above. However, the top block 16 in this embodiment includes a channel 30 to receive a retainer 32 carried by the bottom block 18. In another embodiment, the top block 16 carries the retainer 32 and the bottom block 18 includes the channel 30. In either embodiment, a frangible member 34 is inserted into openings in both the retainer 32 and the walls of the channel 30 to pin the top block 16 and the bottom block 18 together.

Frangible member 34 is designed to resist a load up to a predetermined threshold and then fail, e.g. in a brittle manner, so as to no longer resist the load. In other words, when the frangible member 34 fails, the top block 16 and the bottom block 18 separate at the predetermined load threshold, such as during a destructive pallet jacking incidence, for example, thus reducing damage to the pallet 12.

In one embodiment, the frangible member 34 is replaceable. In another embodiment, the frangible member 34 includes spring locking mechanism 36 that securely positions the frangible member within the top block 16 and/or the bottom block 18. In another embodiment, the frangible member 34 includes failure points 38 at which the frangible member is designed to fail at.

The system 10 addresses durability issues of shipping platforms 12 while also keeping the shipping platforms within standardization requirements. In other words, system 10 changes the dimensions and/or weight of a shipping platform 10 very little. As a result, system 10 can be deployed with little impact to the overall system in which the shipping platforms 12 flow. In addition, the system 10 also provides a retrofit option that can be deployed to improve an existing pool of shipping platforms 12.

In one embodiment, a shipping platform system 10 includes a top deck 14, and a top block 16 joined to the top deck. The system 10 also includes a bottom deck 20, and a bottom block 18 joined to the bottom deck. The system 10 further includes a joint 15 that yields under a predetermined load that joins the top block 16 to the bottom block 18.

In one embodiment, the joint 15 includes interlocking surfaces 17. In another embodiment, one interlocking surface 17 includes a male fitting 24 and another interlocking surface 17 includes a female fitting 22 that mates with the male fitting. In another embodiment, the mated male fitting 24 and the female fitting 22 produce an interference fit that yields at a selected threshold.

In one embodiment, one interlocking surface 17 includes a channel 30 and another interlocking surface 17 includes a retainer 32 that engages the channel. In another embodiment, the system 10 also includes a frangible member 34 that joins the channel 30 and the retainer 32 together.

In one embodiment, the frangible member 34 is replaceable. In another embodiment, the frangible member 34 includes a failure point 38.

In one embodiment, one interlocking surface 17 includes a spring 26 and another interlocking surface 17 includes a catch 28 that engages the spring. In another embodiment, the catch 28 releases the spring 26 at a selected threshold.

Figure 10:
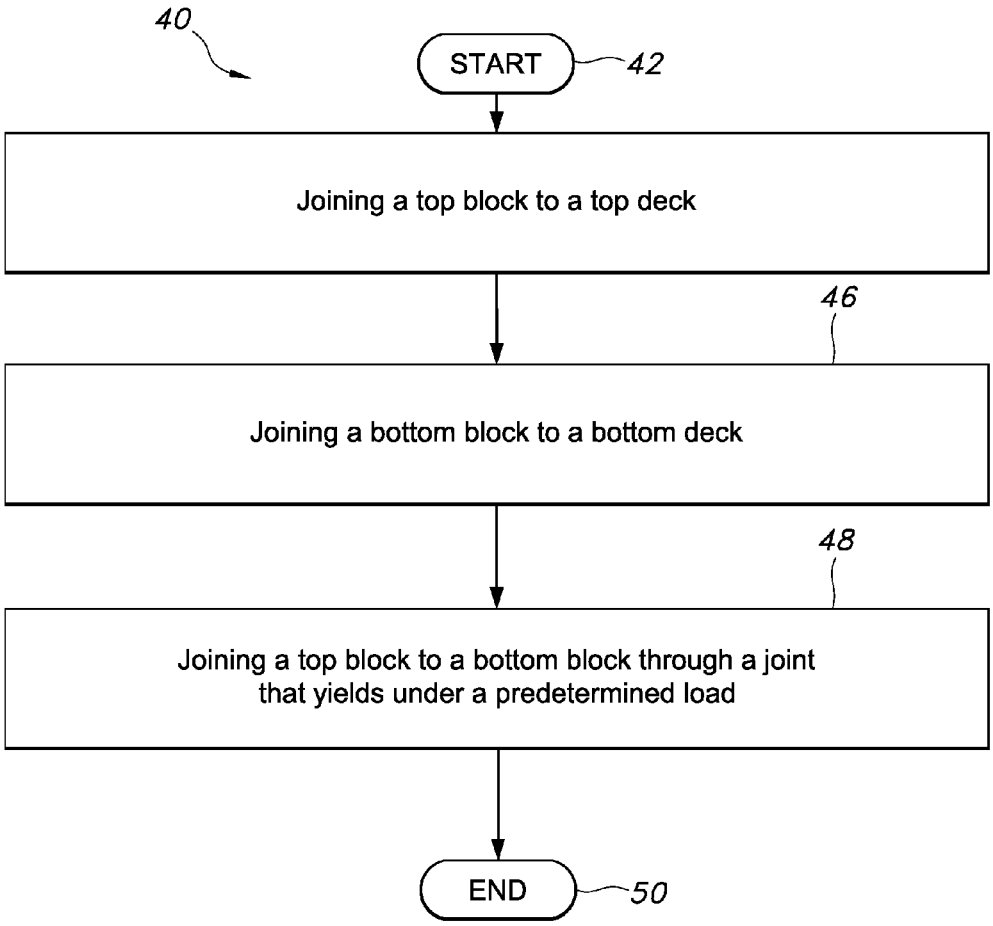
FIG. 10 is a flowchart illustrating method aspects according to embodiments.

Another aspect of the embodiments is a method, which is now described with reference to flowchart 40 of FIG. 10. The method begins at Block 42 and may include joining a top block to a top deck at Block 44. The method may also include joining a bottom block to a bottom deck at Block 46. The method ends at Block 48. The method may further include joining the top block to the bottom block through a joint that yields under a predetermined load at Block 48. The method ends at Block 50.

Figure 11:
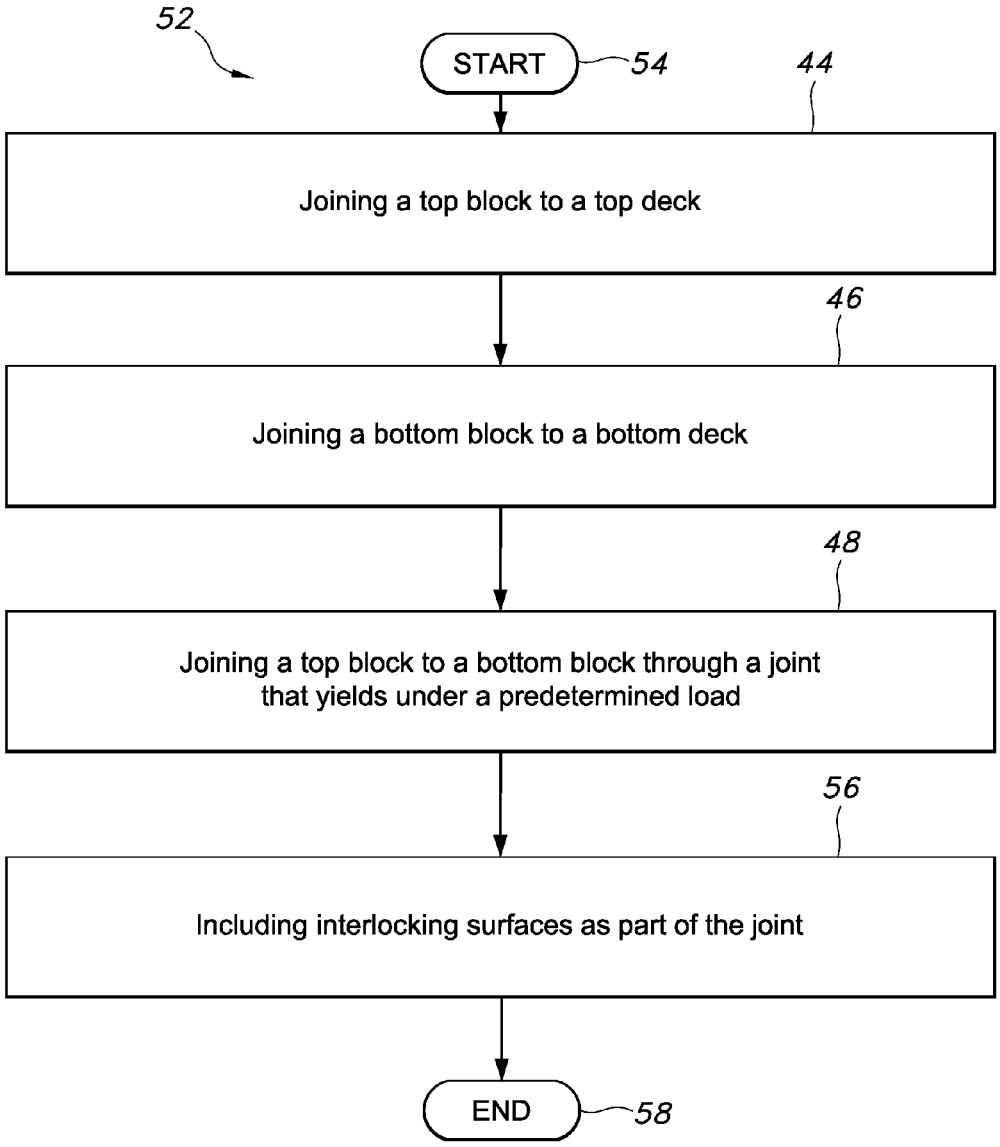
FIG. 11 is a flowchart illustrating method aspects according to the method of FIG. 10.

In another method embodiment, which is now described with reference to flowchart 52 of FIG. 11, the method begins at Block 54. The method may include the steps of FIG. 10 at Blocks 44, 46, and 48. The method may additionally comprise including interlocking surfaces as part of the joint at Block 56. The method ends at Block 58.

Figure 12:
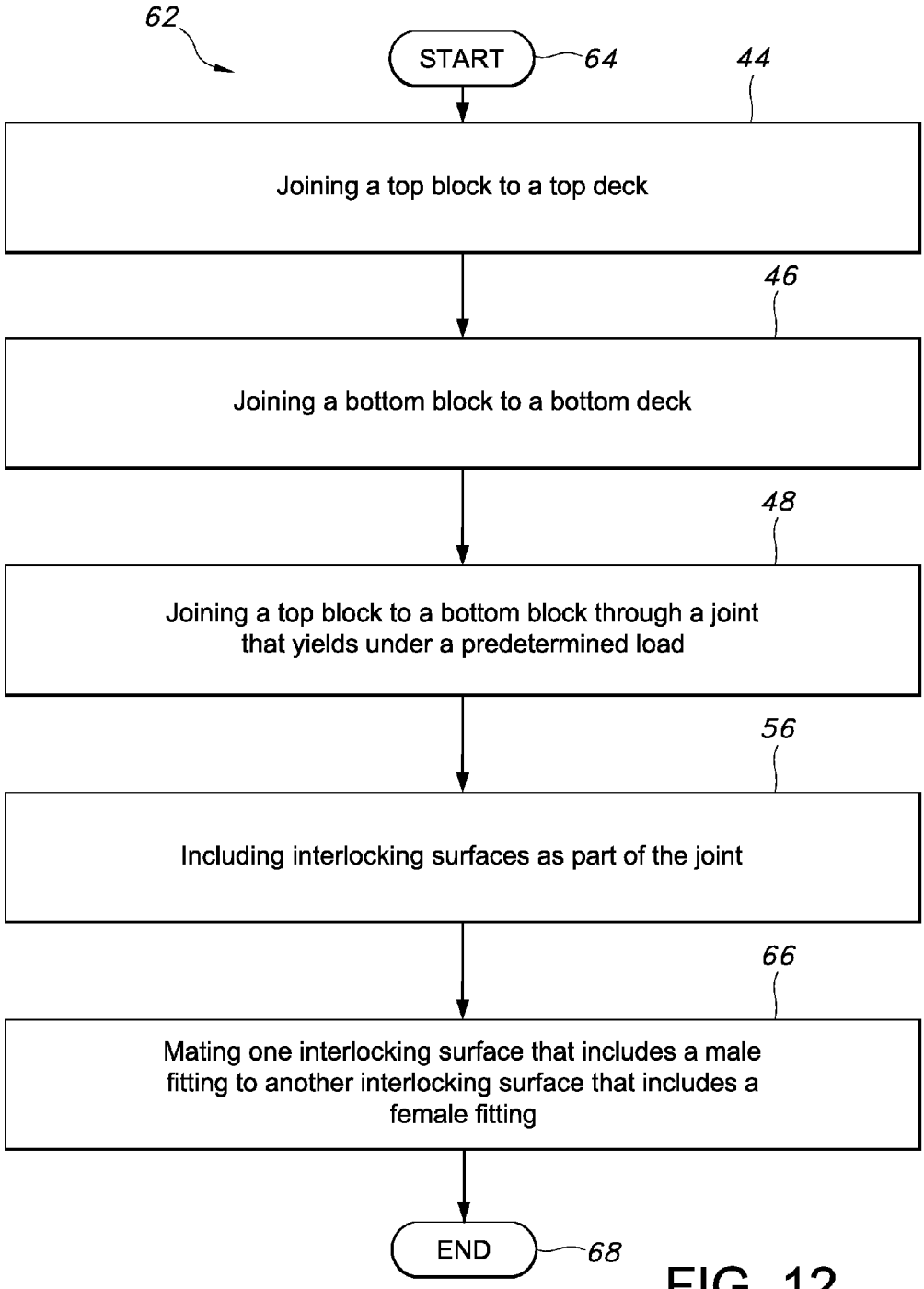
FIG. 12 is a flowchart illustrating method aspects according to the method of FIG. 11.

In another method embodiment, which is now described with reference to flowchart 62 of FIG. 12, the method begins at Block 64. The method may include the steps of FIG. 11 at Blocks 44, 46, 48, and 56. The method may further include mating one interlocking surface that includes a male fitting to another interlocking surface that includes a female fitting at Block 66. The method ends at Block 68.

Figure 13:
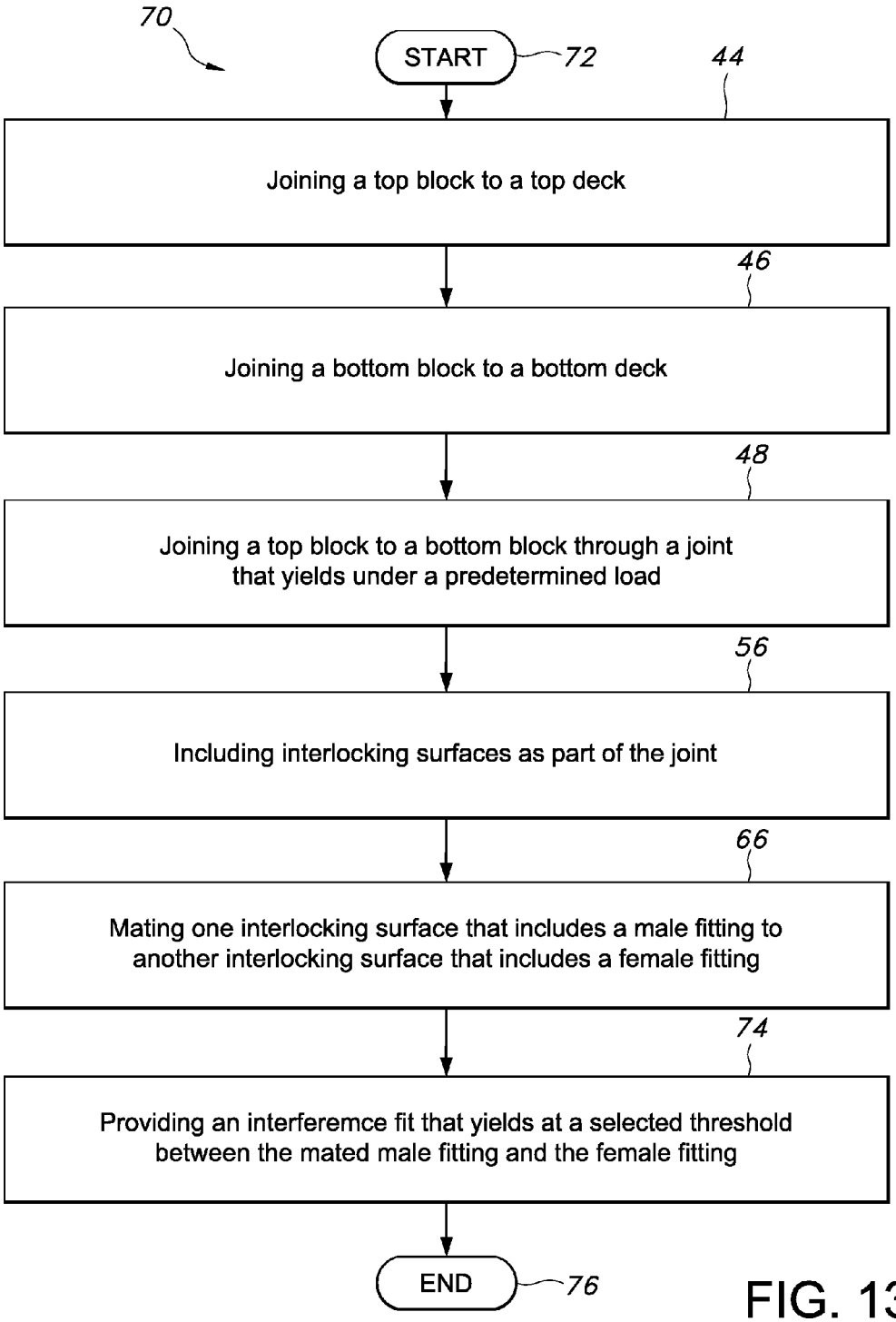
FIG. 13 is a flowchart illustrating method aspects according to the method of FIG. 12.

In another method embodiment, which is now described with reference to flowchart 70 of FIG. 13, the method begins at Block 72. The method may include the steps of FIG. 12 at Blocks 44, 46, 48, 56, and 66. The method may further include providing an interference fit that yields at a selected threshold between the mated male fitting and the female fitting at Block 74. The method ends at Block 76.

Figure 14:
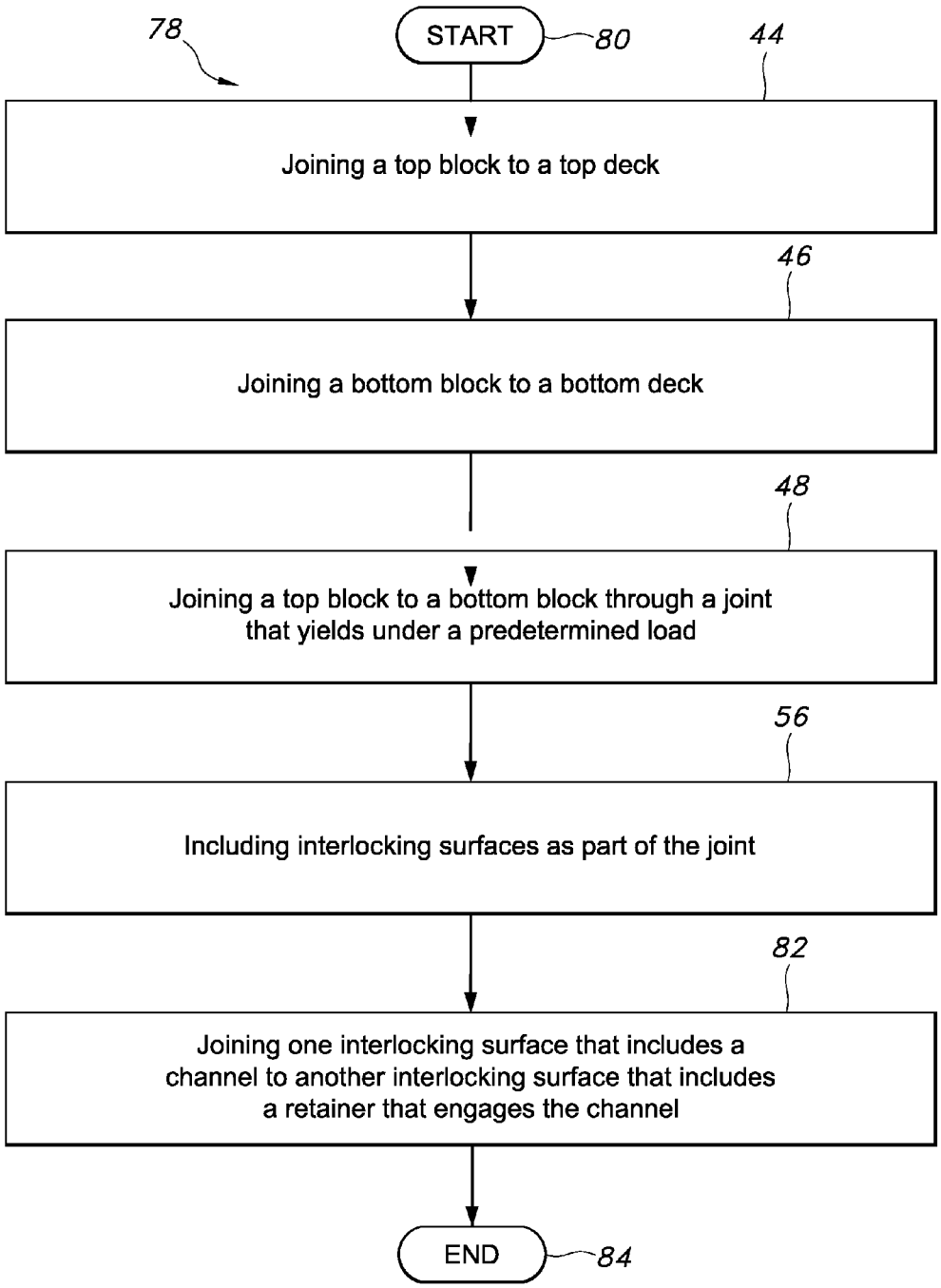
FIG. 14 is a flowchart illustrating method aspects according to the method of FIG. 11.

In another method embodiment, which is now described with reference to flowchart 78 of FIG. 14, the method begins at Block 80. The method may include the steps of FIG. 11 at Blocks 44, 46, 48, and 56. The method may additionally include joining one interlocking surface that includes a channel to another interlocking surface that includes a retainer that engages the channel at Block 82. The method ends at Block 84.

Figure 15:
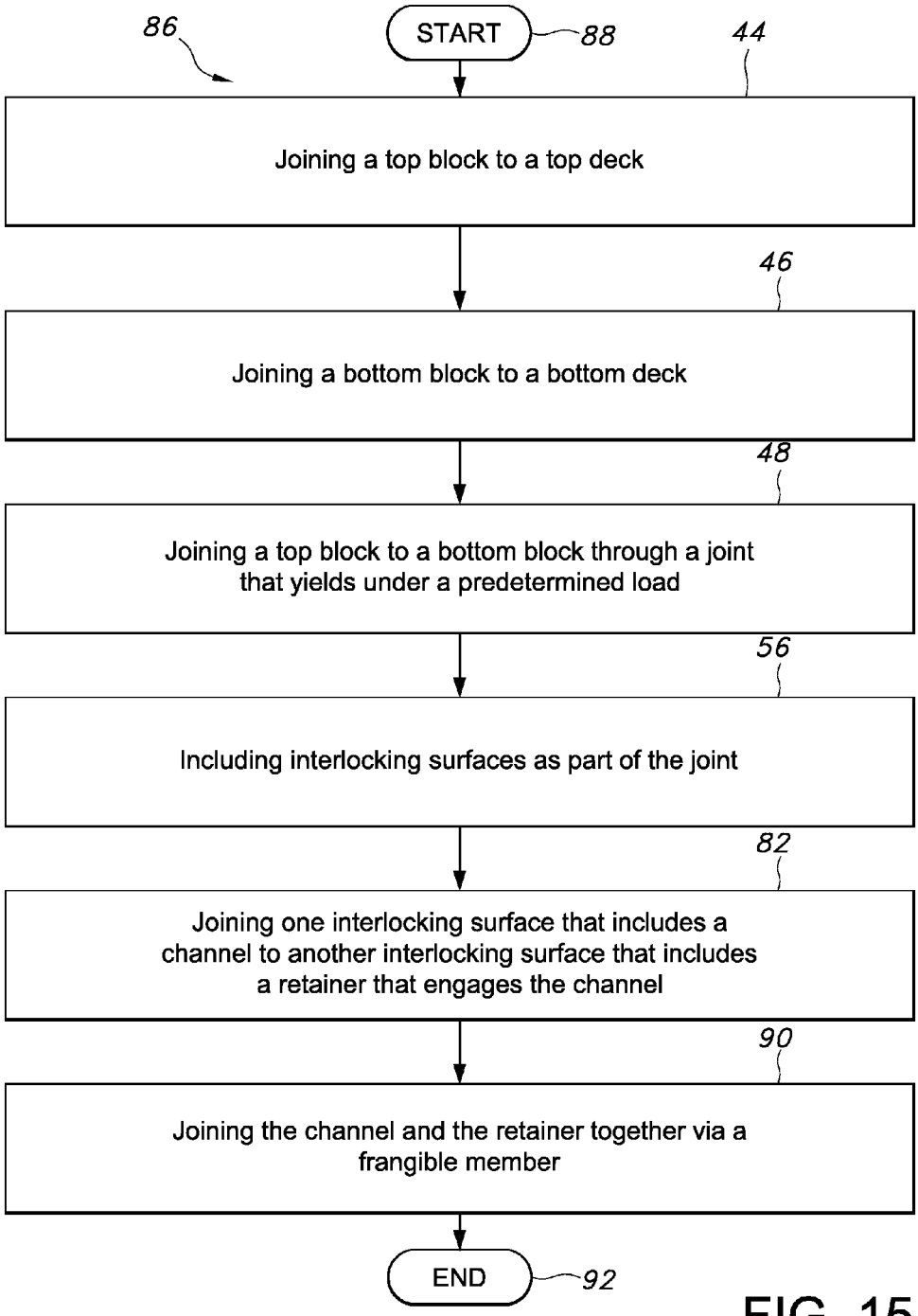
FIG. 15 is a flowchart illustrating method aspects according to the method of FIG. 14.

In another method embodiment, which is now described with reference to flowchart 86 of FIG. 15, the method begins at Block 88. The method may include the steps of FIG. 13 at Blocks 44, 46, 48, 56, and 82. The method may additionally include joining the channel and the retainer together via a frangible member at Block 90. The method ends at Block 92.

Figure 16:
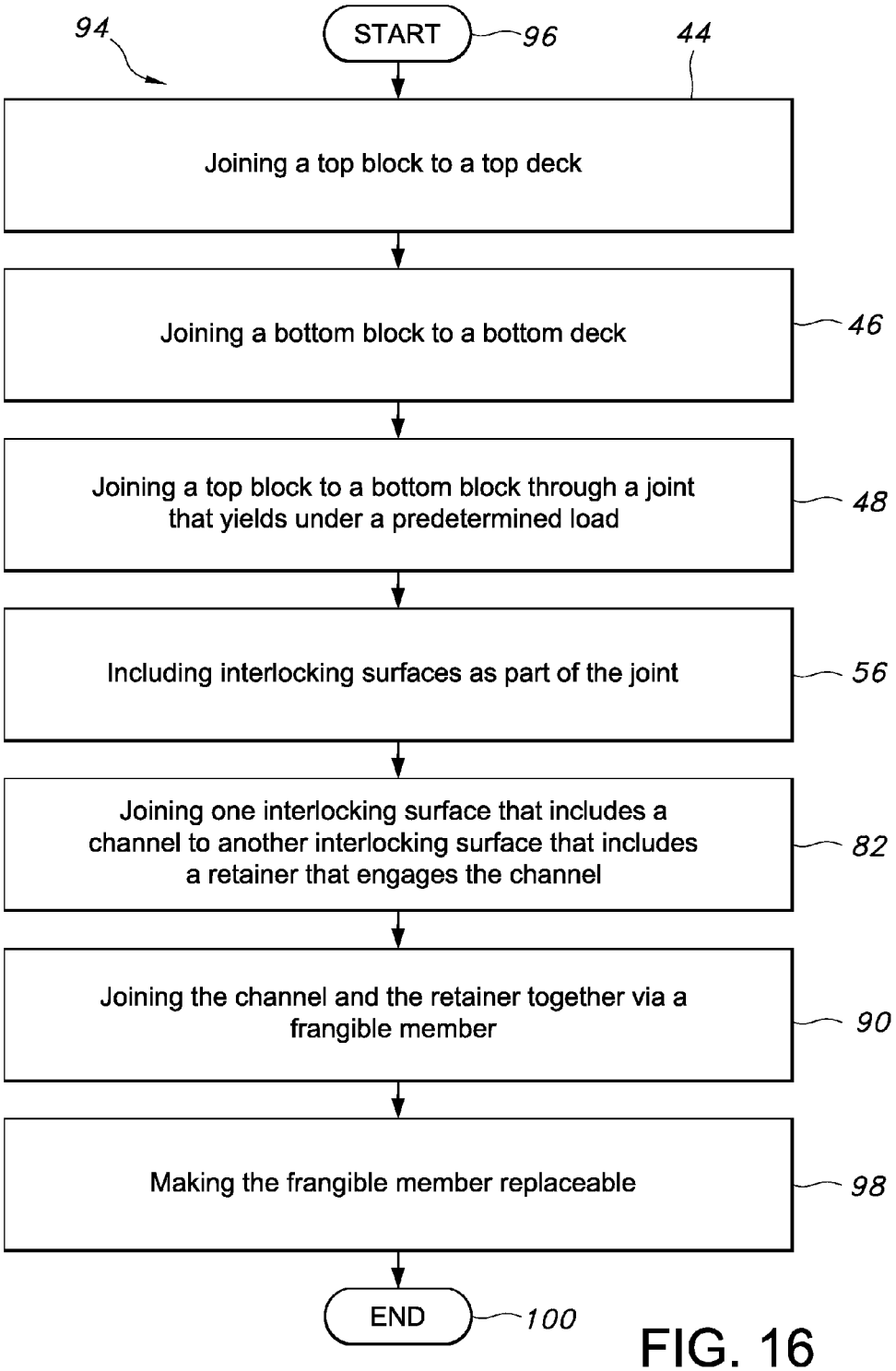
FIG. 16 is a flowchart illustrating method aspects according to the method of FIG. 15.

In another method embodiment, which is now described with reference to flowchart 94 of FIG. 16, the method begins at Block 96. The method may include the steps of FIG. 15 at Blocks 44, 46, 48, 56, 82, and 90. The method may additionally include making the frangible member replaceable at Block 98. The method ends at Block 100.

Figure 17:
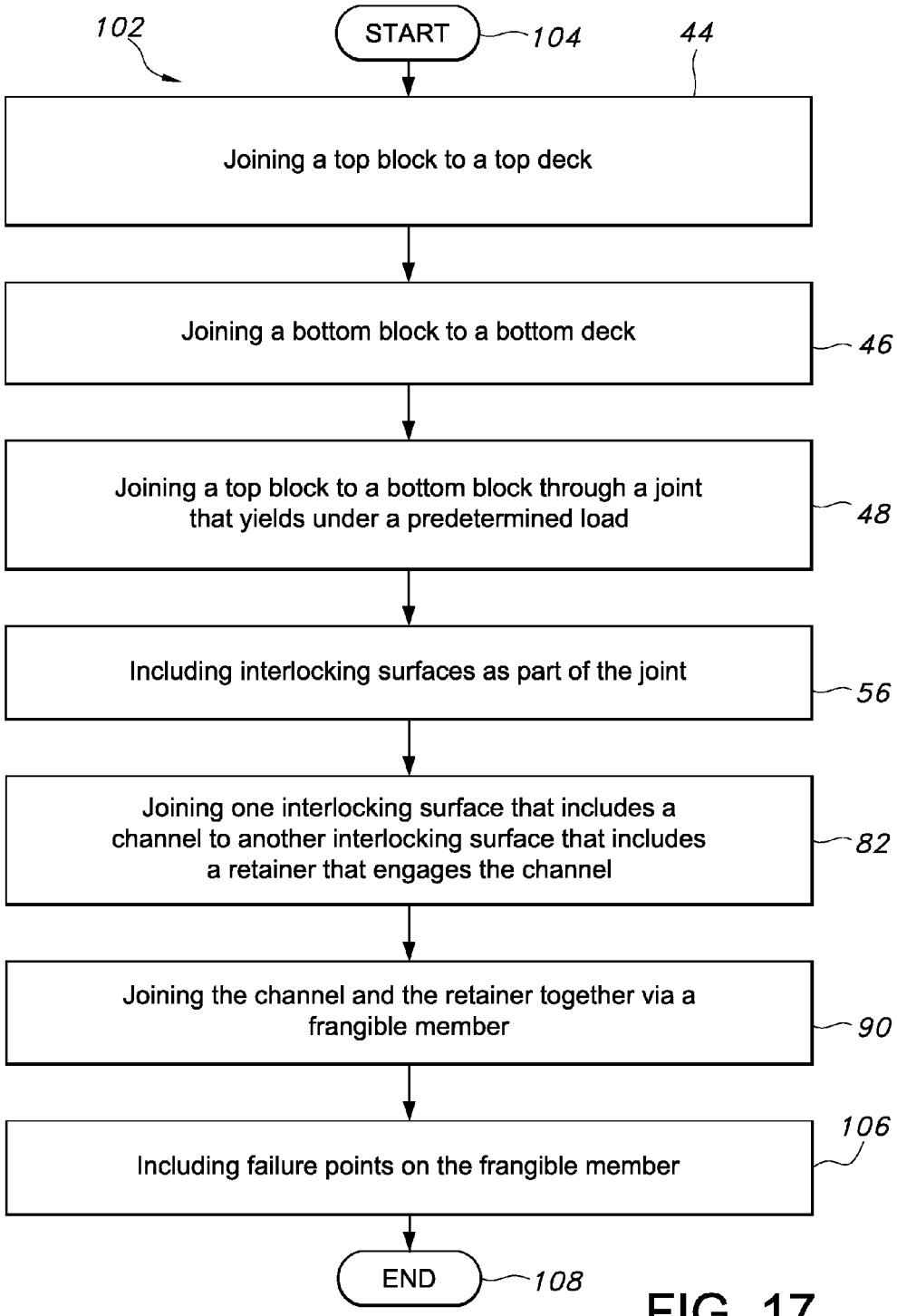
FIG. 17 is a flowchart illustrating method aspects according to the method of FIG. 15.

In another method embodiment, which is now described with reference to flowchart 102 of FIG. 17, the method begins at Block 104. The method may include the steps of FIG. 15 at Blocks 44, 46, 48, 56, 82, and 90. The method may additionally comprise including failure points on the frangible member at Block 106. The method ends at Block 108.

Figure 18:
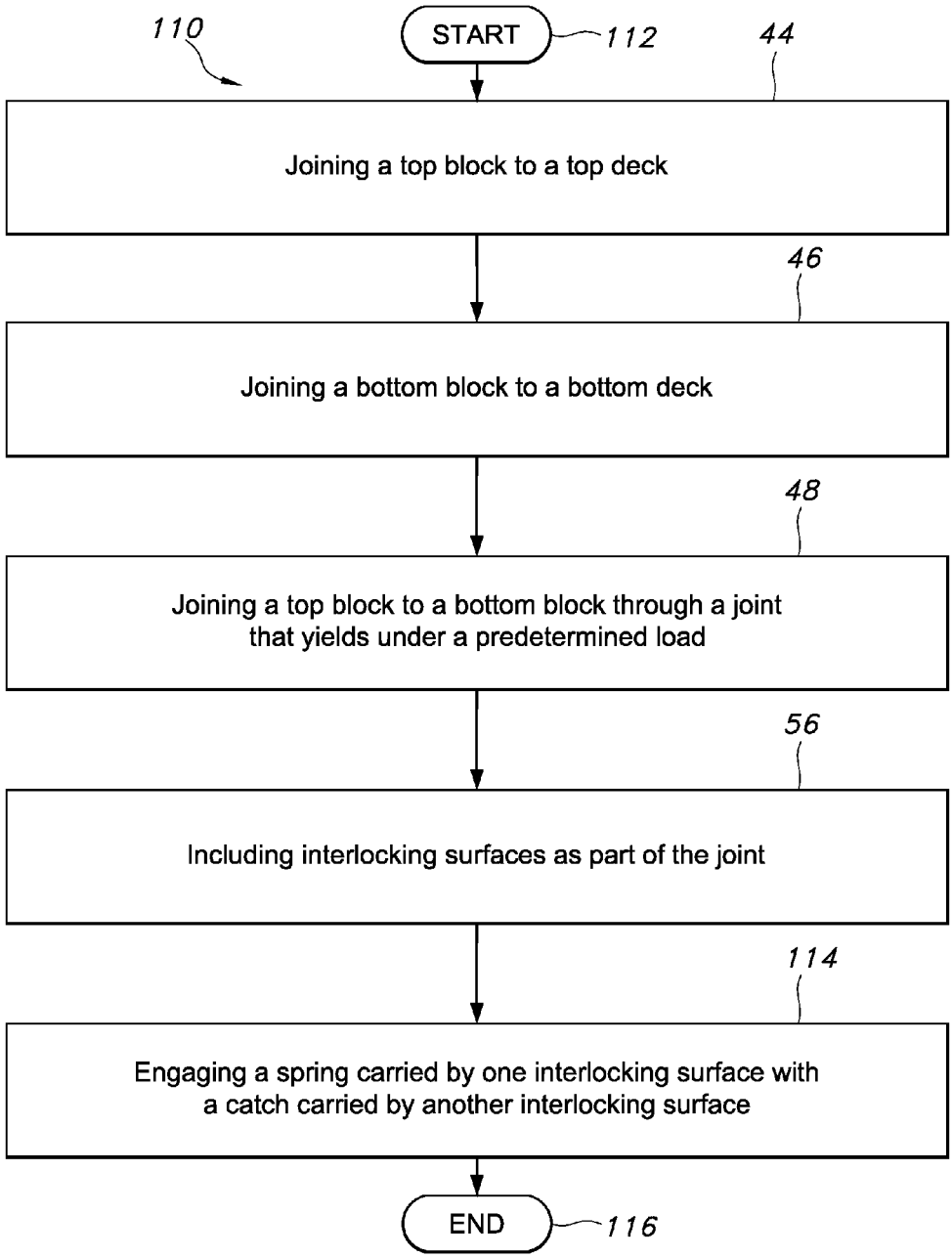
FIG. 18 is a flowchart illustrating method aspects according to the method of FIG. 11.

In another method embodiment, which is now described with reference to flowchart 110 of FIG. 18, the method begins at Block 112. The method may include the steps of FIG. 11 at Blocks 44, 46, 48, and 56. The method may additionally include engaging a spring carried by one interlocking surface with a catch carried by another interlocking surface at Block 114. The method ends at Block 116.

Figure 19:
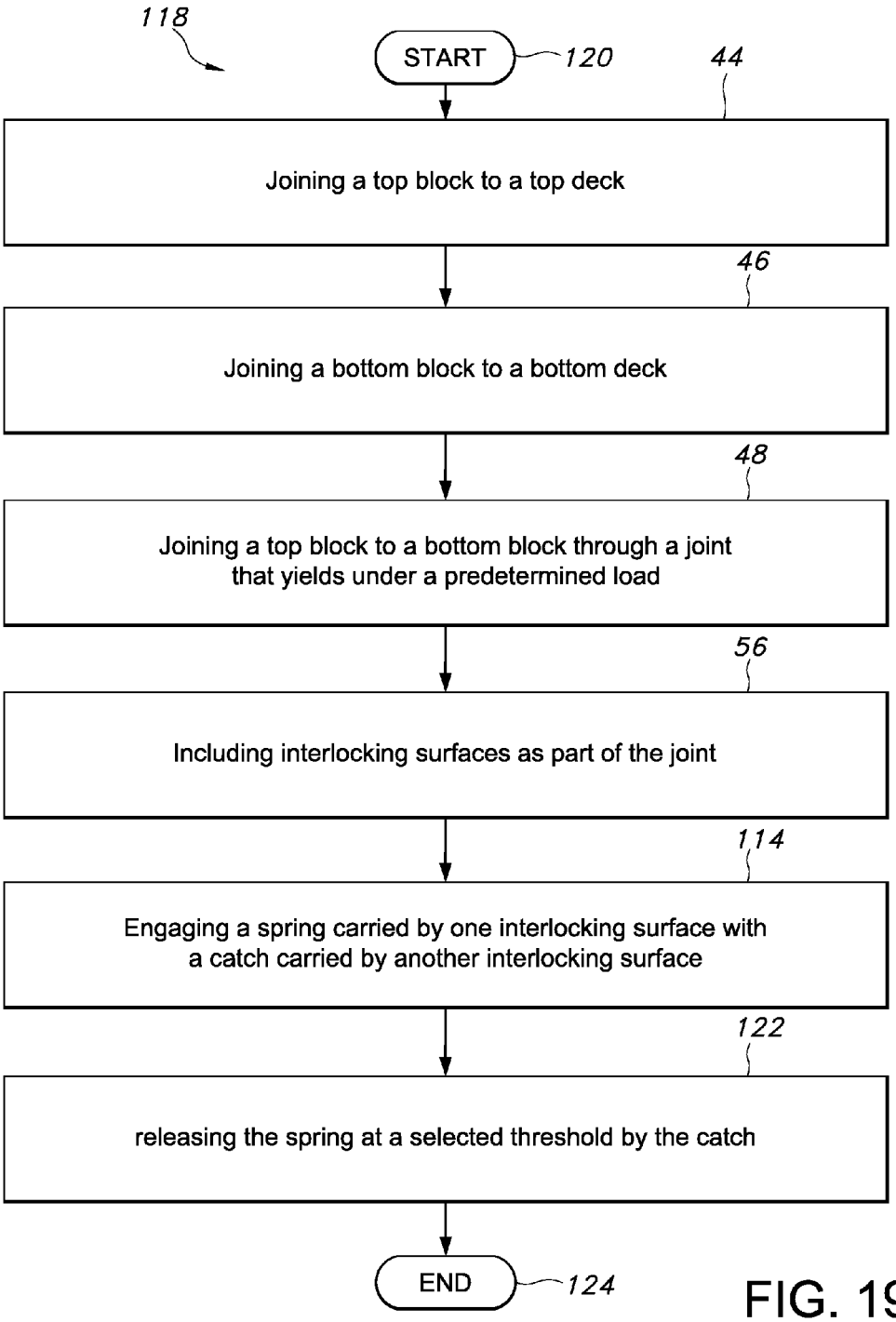
FIG. 19 is a flowchart illustrating method aspects according to the method of FIG. 18.

In another method embodiment, which is now described with reference to flowchart 118 of FIG. 19, the method begins at Block 120. The method may include the steps of FIG. 18 at Blocks 44, 46, 48, 56, and 114. The method may additionally include releasing the spring at a selected threshold by the catch at Block 122. The method ends at Block 124.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the embodiments. The embodiment was chosen and described in order to best explain the principles of the embodiment and the practical application, and to enable others of ordinary skill in the art to understand the various embodiments with various modifications as are suited to the particular use contemplated.

It should be noted that in some alternative implementations, the functions noted in a flowchart block may occur out of the order noted in the figures. For instance, two blocks shown in succession may, in fact, be executed substantially concurrently, or the blocks may sometimes be executed in the reverse order, depending upon the functionality involved because the flow diagrams depicted herein are just examples. There may be many variations to these diagrams or the steps (or operations) described therein without departing from the spirit of the embodiments. For example, the steps may be performed concurrently and/or in a different order, or steps may be added, deleted, and/or modified. All of these variations are considered a part of the claimed embodiments.

While the preferred embodiment have been described, it will be understood that those skilled in the art, both now and in the future, may make various improvements and enhancements which fall within the scope of the claims which follow. These claims should be construed to maintain the proper protection for the embodiments first described.

What is claimed is:

1. A shipping platform system comprising:

a top deck;

a top block joined to the top deck;

a bottom deck;

a bottom block joined to the bottom deck; and a joint that yields under a predetermined load that joins the top block to the bottom block, wherein the joint comprises interlocking surfaces, wherein one interlocking surface includes a channel and another interlocking surface includes a retainer that engages the channel; and a frangible member that joins the channel and the retainer together; and wherein the frangible member is replaceable;

wherein a first section of the frangible member includes a locking clip; and wherein a second section of the frangible member is grooved around a shaft of the frangible member at a failure point.

2. The system of claim 1 wherein one interlocking surface includes a male fitting and another interlocking surface includes a female fitting that mates with the male fitting.

3. The system of claim 2 wherein the male fitting and the female fitting produce an interference fit when mated that yields at a selected threshold.

4. The system of claim 1 wherein one interlocking surface includes a spring and another interlocking surface includes a catch that engages the spring.

5. The system of claim 4 wherein the catch releases the spring at a selected threshold.

6. The system of claim 1, wherein the top block is replaceably joined to the top deck.

7. The system of claim 1, wherein the locking clip includes spaced apart tips, each of the tips including a locking tab.

8. A method comprising:

joining a top block to a top deck, the top block including a channel;

joining a bottom block to a bottom deck, the bottom block including a retainer that engages the channel;

providing a frangible member that joins the channel and the retainer together with a locking clip at a first section and grooves around a shaft of the frangible member at a second section, the grooves defining failure points at the frangible member; and joining the top block to the bottom block through a joint that yields under a predetermined load.

9. The method of claim 8 further comprising including interlocking surfaces as part of the joint.

10. The method of claim 9 further comprising mating one interlocking surface that includes a male fitting to another interlocking surface that includes a female fitting.

11. The method of claim 10 providing an interference fit that yields at a selected threshold between the mated male fitting and the female fitting.

12. The method of claim 9 further comprising joining one interlocking surface that includes the channel to another interlocking surface that includes the retainer that engages the channel.

13. The method of claim 9 further comprising joining the channel and the retainer together via the frangible member.

14. The method of claim 13 further comprising making the frangible member replaceable.

15. The method of claim 13 further comprising including the failure points on the frangible member.

16. The method of claim 9 further comprising engaging a spring carried by one interlocking surface with a catch carried by another interlocking surface.

17. The method of claim 16 further comprising releasing the spring at a selected threshold by the catch.

* * * * *